US006945359B2

(12) United States Patent
Logiudice

(10) Patent No.: US 6,945,359 B2
(45) Date of Patent: Sep. 20, 2005

(54) LADDER SLEEVE

(75) Inventor: John Logiudice, Lake Mary, FL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 44 days.

(21) Appl. No.: 10/768,826

(22) Filed: Jan. 30, 2004

(65) Prior Publication Data

US 2005/0167197 A1 Aug. 4, 2005

(51) Int. Cl.[7] ..... E04G 5/02; E06C 7/06
(52) U.S. Cl. ..... 182/107; 182/214
(58) Field of Search ..... 182/107, 214, 182/108, 129; 224/264, 265, 907, 270

(56) References Cited

U.S. PATENT DOCUMENTS

| | | | | |
|---|---|---|---|---|
| 2,963,104 | A | 12/1960 | Ruth | |
| 3,196,980 | A | 7/1965 | Rorden | |
| 3,780,829 | A | 12/1973 | Wallingford | |
| 3,792,756 | A | 2/1974 | Kelly | |
| 4,545,460 | A | 10/1985 | Byrd | |
| 4,726,446 | A | 2/1988 | Perbix | |
| 4,924,971 | A | 5/1990 | Rice | |
| 5,054,581 | A | 10/1991 | Henson | |
| 5,067,588 | A | 11/1991 | Bendickson | |
| 5,529,145 | A | 6/1996 | Allred | |
| 5,896,945 | A | 4/1999 | Boelling | |
| 6,044,930 | A | 4/2000 | Hayman | |
| 6,390,236 | B1 * | 5/2002 | Eastman | 182/107 |

* cited by examiner

*Primary Examiner*—Hugh B. Thompson, II
(74) *Attorney, Agent, or Firm*—Walters & Zimmerman; Jennifer Medlin; Todd Mitchem

(57) ABSTRACT

A sleeve is disclosed for a leg of a ladder. The sleeve includes a length of generally "U"-shaped cross-sectional material, and the sleeve slides over an end of the leg of the ladder. Each rung of the ladder slides along an open portion of the generally "U"-shaped cross-section as the sleeve is slid over and along the leg of the ladder. When the ladder rests against an object, the sleeve can be longitudinally adjusted along the leg to reduce marring the object from contact by the leg of the ladder.

15 Claims, 8 Drawing Sheets

LADDER SLEEVE

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to ladders and, more particularly, to safety devices for ground-supported ladders.

2. Description of the Related Art

When a user ascends a ladder, safety is of utmost importance. Ladder safety, in fact, is so important that many industries and companies require various safety procedures when using ladders. One telecommunications service provider, for example, requires that a technician utilize a special safety procedure to secure a ladder to prevent sliding/slippage as the technician ascends the ladder. This safety procedure requires much time and effort before the ladder can be extended and ascended. Because this safety procedure requires much time and effort, repairs take longer.

One example of these safety procedures involves communications cables. Sometimes a technician must access a terminal to provide communications service to a customer. Although most terminals are readily accessible (such as when mounted on utility poles), some terminals are not so easily accessed. Some terminals, in fact, are located far from a utility pole, and the technician must lean a ladder on a communications cable. When the technician must lean/prop the ladder against a communications cable, the safety procedures are very strict. The safety procedures require the technician to "tie" the ladder to the communications cable. That is, the technician must wrap a rope around the ladder and the communications cable, and the rope must be tied with a special knot. This safety procedure is time consuming, and the required, special knot is difficult to master. Even though the ladder is "tied off," the ladder can sometimes still slide along the communications cable and compromise stability. There is, accordingly, a need in the art for new methods of securing a ladder, a need in the art for an apparatus that allows a user to secure a ladder, and a need in the art for an apparatus that is quickly and easily adapted to various situations/applications.

BRIEF SUMMARY OF THE INVENTION

The aforementioned problems are reduced by a sleeve for a leg of a ladder. The sleeve slides onto and over a single leg of the ladder. When the ladder rests against an object, such as a wall, the sleeve helps reduce scratching and scraping of the object. This sleeve also includes improvements and features that reduce slippage along the object, such as slip-resistant materials and coverings. The sleeve of this invention also includes features and improvements that help secure and stabilize the ladder. The features and improvements of this invention, then, allow a user to ascend the ladder in a safer and securer manner, and these features and improvements reduce damage to walls and other objects. This invention, then, allows a user to work safer and faster with less touch-up.

One of the embodiments of this invention describes a sleeve for a leg of a ladder. The sleeve includes a length of generally "U"-shaped cross-sectional material, and the sleeve slides over an end of the leg of the ladder. Each rung of the ladder slides along an open portion of the generally "U"-shaped cross-section as the sleeve is slid over and along the leg of the ladder. When the ladder rests against an object, the sleeve can be longitudinally adjusted along the leg to reduce marring the object from contact by the leg of the ladder.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

This invention now will be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

This invention is a sleeve for a single leg of a ladder. The sleeve slides onto and over the single leg of the ladder. When the ladder rests against an object, such as a wall, the sleeve helps reduce scratching and scraping of the object. This sleeve also includes improvements and features that reduce slippage along the object, such as slip-resistant materials and coverings. The sleeve of this invention also includes features and improvements that help secure and stabilize the ladder. The features and improvements of this invention, then, allow a user to ascend the ladder in a safer and securer manner, and these features and improvements reduce damage to walls and other objects. This invention, then, allows a user to work safer and faster with less touch-up.

Figure 1:
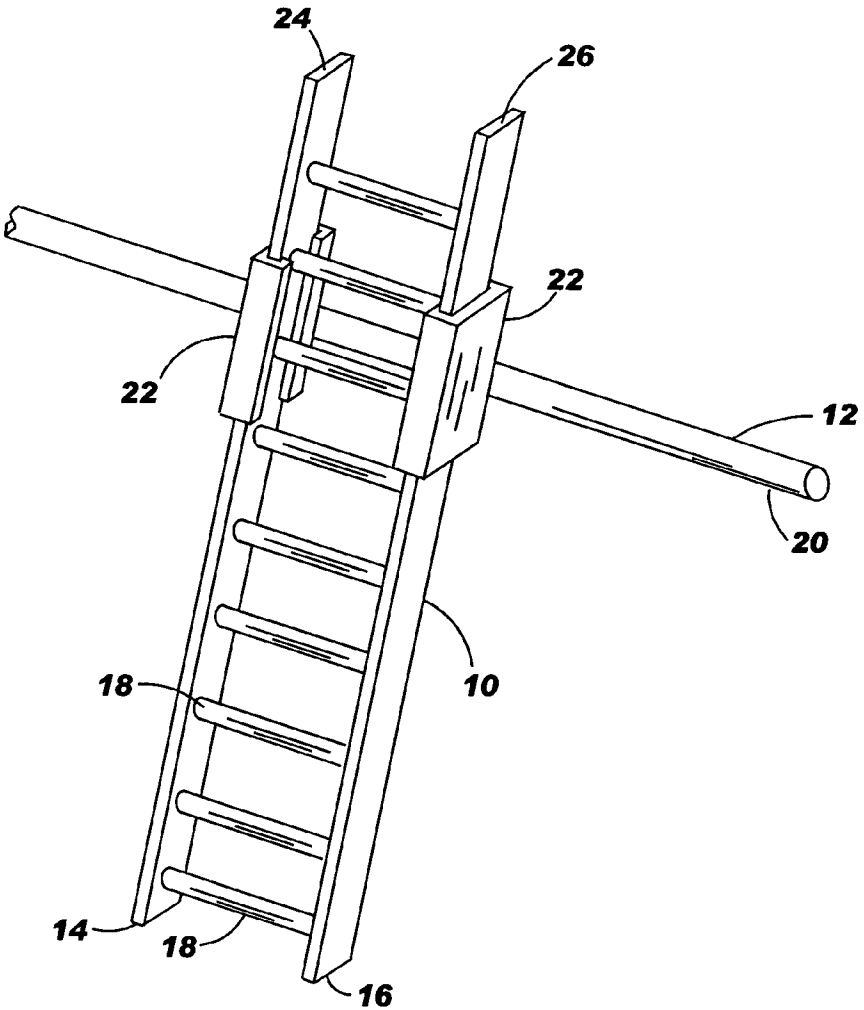
FIG. 1 is a schematic illustrating a conventional ladder in an upright position and propped against an object.

FIG. 1 is a schematic illustrating one of the operating environments for this invention. FIG. 1 shows a conventional ladder 10 in an upright position and propped against an object 12. The ladder 10 has a left side leg 14 and a right side leg 16. A plurality of horizontal rungs 18 extend between, and are secured to, the side legs 14 and 16. The ladder 10 is constructed of steel, aluminum, fiberglass, wood, and/or other material. The ladder 10, for simplicity, is shown as having a fixed length. The ladder 10, however, could also be an extension ladder that can vary in length or a ladder than can fold. FIG. 1 shows the object 12 as a railing 20, although those of ordinary skill in the art understand the object 12 may be a wall, cable, eave of a roof, and/or other objects too numerous to mention. Because the ladder 10 is conventional and well-known to those of ordinary skill in the art, this patent will not further describe the componentry and the operation of the ladder 10.

The ladder 10 also includes a pair of sleeves 22. As the ladder 10 is propped against, and/or moved along, the object 12, the ladder 10 can scratch, scrape, and, in general, mar the object 12. As this patent will explain, each sleeve 22 is slid over each an end 24, 26 of each respective side leg 14, 16. That is, one sleeve 22 is slid over the end 24 of the leg 14, while another sleeve 22 is slid over the end 26 of the other leg 16. Each sleeve 22 is positioned along each respective side leg 14, 16 to protect the object 12 from marring. As the ladder 10 is propped against, and moved along, the object 12, the sleeves 22 act as protective slip covers to help reduce marring of the object 12 by the side legs 14 and 16.

Figure 2:
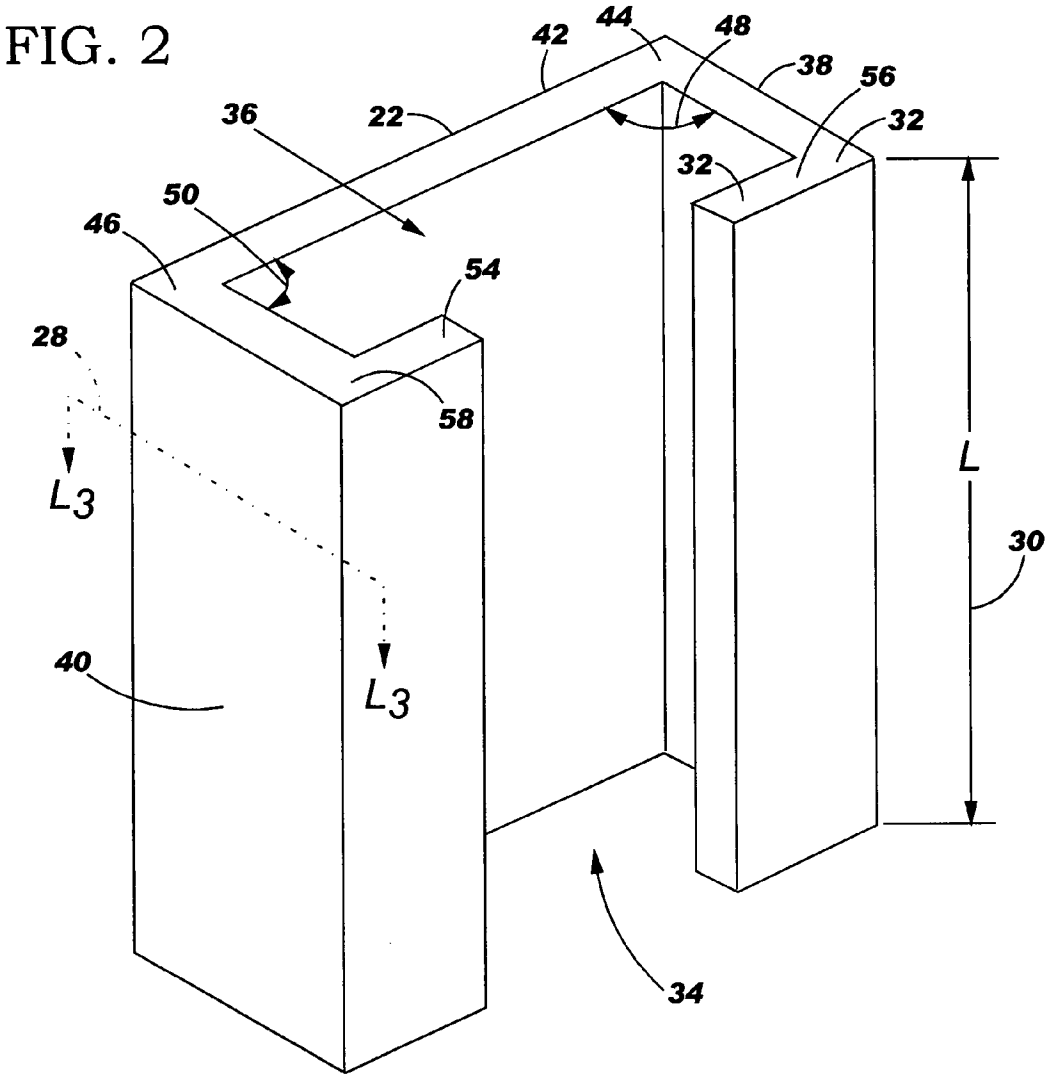
FIG. 2 is an isometric view of a sleeve shown in FIG. 1, according to the embodiments of this invention.
Figure 3:
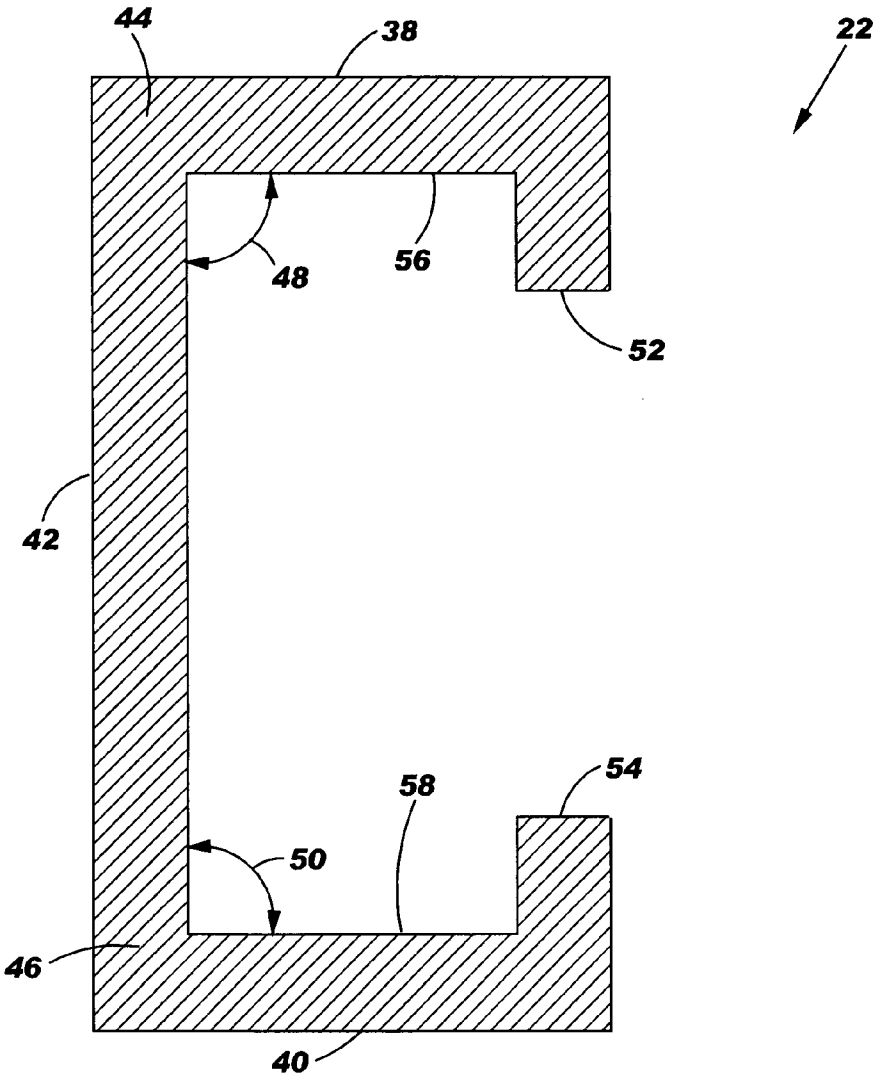
FIG. 3 is a sectional side view of the sleeve taken along line $L_3$—$L_3$ of FIG. 2, according to more embodiments of this invention.

FIGS. 2 and 3 are schematics illustrating the sleeves 22 shown in FIG. 1. FIG. 2 is an isometric view of the sleeve 22. FIG. 3 is a sectional side view of the sleeve 22 taken along line $L_3$—$L_3$ (shown as reference numeral 28) of FIG. 2. Each sleeve 22 comprises a length L (shown as reference numeral 30) of generally "U"-shaped cross-sectional material (shown as reference numeral 32). The length L can be of any length, however, the length L of the sleeve 22 is typically from about twelve inches (12 in) to about twenty four inches (24 in). As the sleeve 22 is slid over the end of the leg of the ladder, each rung of the ladder slides along an open portion 34 of the generally "U"-shaped cross-section (the ends, legs, ladder, and rungs are shown, respectively, as reference numerals 24 and 26, 14 and 16, 10, and 18 in FIG. 1). The open portion 34 resembles a slot 36 in the sleeve 22, such that as the sleeve 22 is slid over and along the single leg of the ladder, the rungs slide along and pass through the slot 36. The slot 36 thus allows the sleeve 22 to be longitudinally positioned along the leg to best reduce marring of the object from contact by the leg of the ladder.

FIGS. 2 and 3 also show more details of the sleeve 22. The sleeve 22 comprises a front section 38, a back section 40, and a side section 42. The front section 38 extends from one end 44 of the side section 42. The back section 40 extends from an opposite end 46 of the side section 42. The front section 38 and the back section 40 each typically perpendicularly extend (shown, respectively, as reference numerals 48 and 50) from the side section 42, thus forming the generally "U"-shaped cross-section of the sleeve 22. The "U"-shaped cross-section of the sleeve 22, however, need not have this perpendicular arrangement, yet this perpendicular arrangement likely conforms to the cross-sectional shape of the legs of most ladders.

The sleeve 22 may also comprise a front flange 52 and/or a back flange 54. The front flange 52 extends at least partially along an outer edge 56 of the front section 38. The back flange 54 extends at least partially along an outer edge 58 of the back section 40. The flanges 52 and 54 help retain and guide the sleeve 22 along the leg of the ladder.

Figure 4:
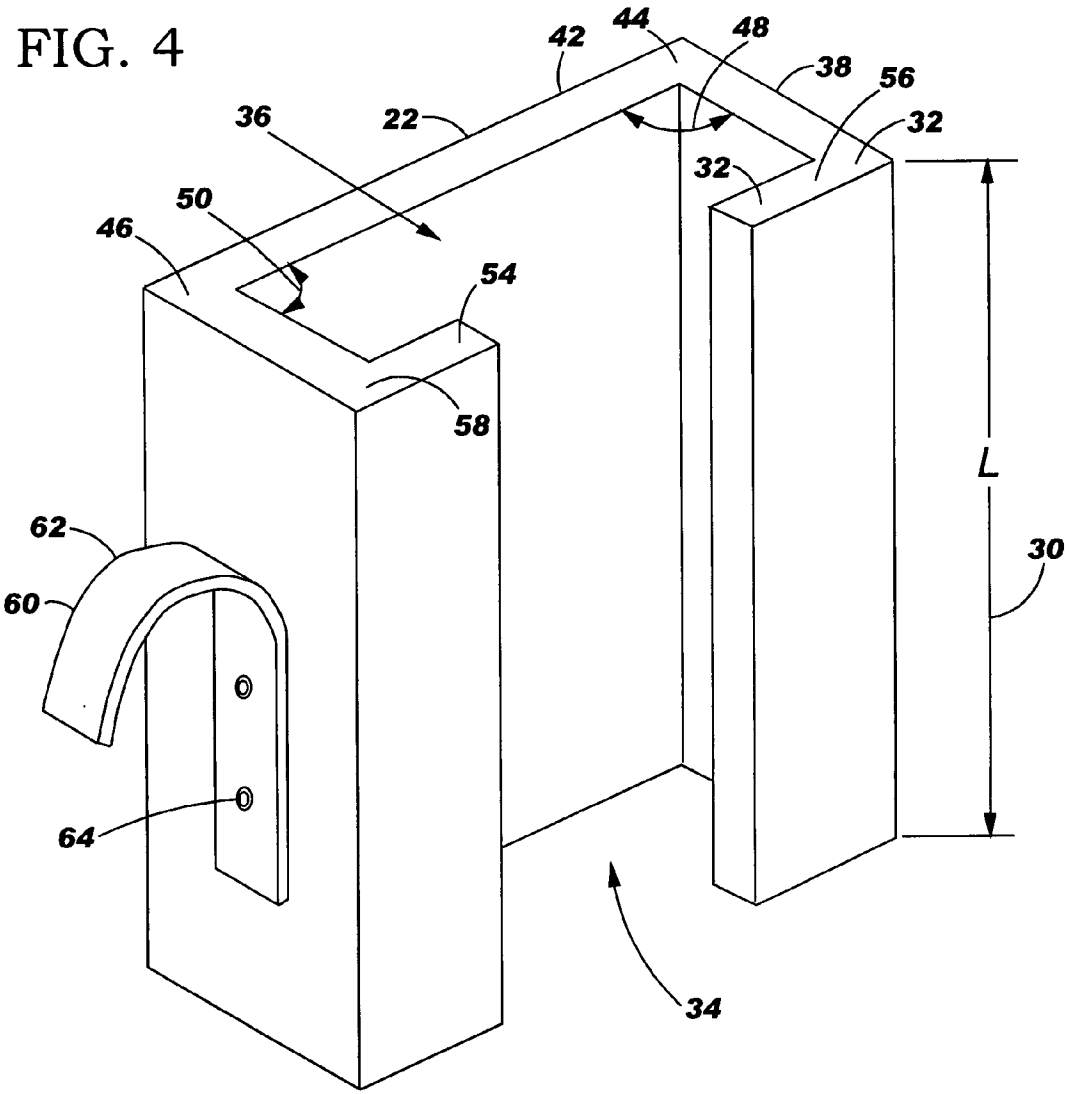
FIGS. 4 and 5 are schematics illustrating more details of the sleeve shown in FIGS. 1–3, according to still more embodiments of this invention.
Figure 5:
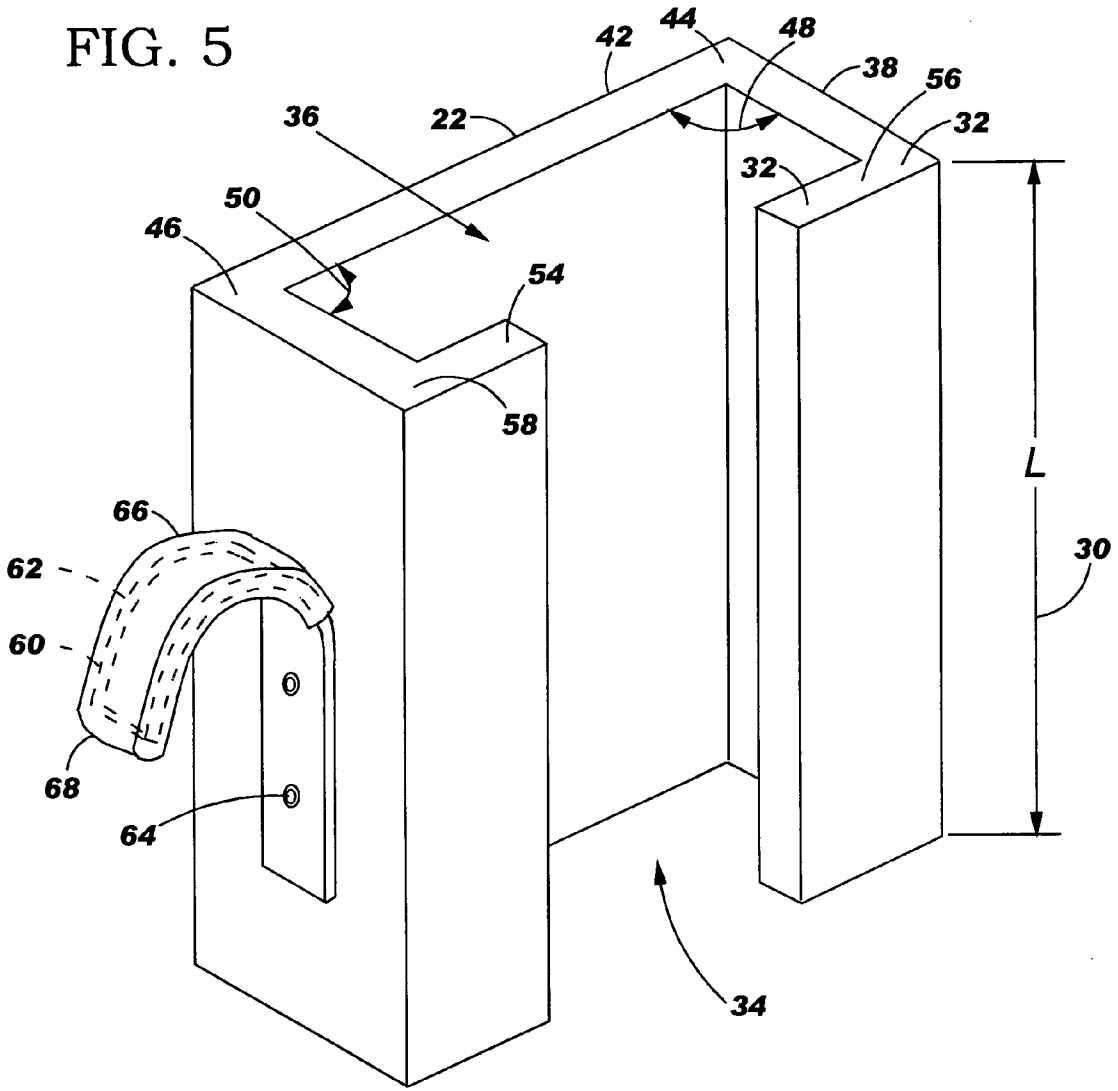

FIGS. 4 and 5 are schematics illustrating more details of the sleeve 22 shown in FIGS. 1–3. Here the sleeve 22 comprises a hooking member 60 attachable to the sleeve 22. The hooking member 60 resembles a "J"-shaped hook 62 and allows a user to "hook" the sleeve 22, and thus secure the leg of the ladder, to the object. FIG. 4 shows the hooking member 60 attached to the sleeve 22 by one or more rivets 64. The hooking member 60, however, could also be attached using bolts, screws, other threaded fasteners, adhesives, and welds. The front section 38 and/or the back section 40 may even include one or more slots into which the hooking member 60 may slide. These slots would allow the hooking member 60 to be inserted into, and removed from, the sleeve 22 when the need arises. The slots could be formed from a band of material that outwardly protrudes from either the front section 38 and/or the back section 40. The band of material creates a channel through which the hooking member 60 may slide.

As FIG. 5 shows, the hooking member 60 may also comprise a slip-resistant material 66. Because the hooking member 60 is perhaps most economically formed of metal material (such as flat band stock), the metallic hooking member 60 may easily slide along the object. The slip-resistant material 66 increases the coefficient of friction and, thus, helps reduce slippage along the object. The slip-resistant material 66 extends at least along partially along the "J"-shaped hook 62. The slip-resistant material 66 may be any material that increases the coefficient of friction of the hooking member 60 and, thus, helps reduce slippage. The slip-resistant material 66, for example, may be a powder coating, a tape or other wrap, a molded polymer sleeve, and/or a chemical/plastic dip. FIG. 5 shows the hooking member comprising a rubber sleeve 68 to reduce slippage along the object.

Figure 6:
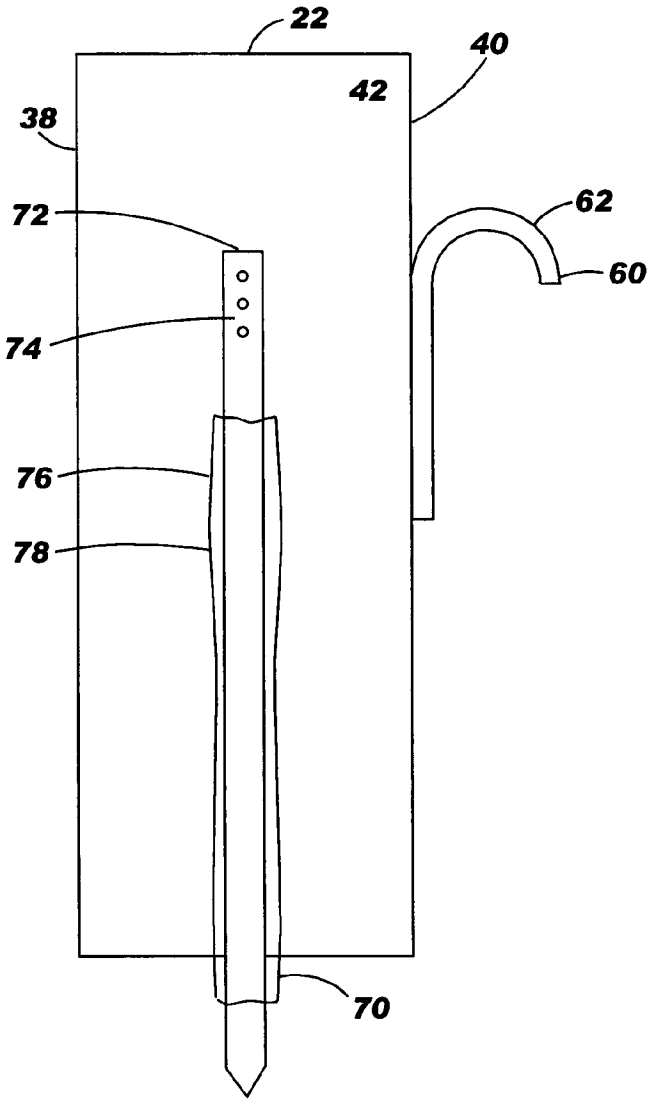
FIG. 6 is a side orthographic view illustrating more details of the sleeve according to the embodiments of this invention.

FIG. 6 is a side orthographic view illustrating more details of the sleeve 22 shown in FIGS. 1–5. Here the sleeve 22 comprises a strap 70 for securing the sleeve, and thus the leg of the ladder, to the object. The strap 70 has a first end 72 attached to the sleeve 22. The first end 72 of the strap 70 is shown attached to the side section 42. The first end 72 of the strap 70, however, may alternatively be attached to any portion of the front section 38 or the back section 40. FIG. 6 shows the first end 72 of the strap 70 attached to the side section 42 by one or more rivets 74. The first end 72 of the strap 70, however, could also be attached using bolts, screws, other threaded fasteners, adhesives, threading/stitching, buckle, snap, or knot. The strap 70 may have any length, yet the strap 70 preferably has a length that allows the sleeve 22 to be secured to the object.

The strap 70 may also comprise a slip-resistant outer jacket 76. This slip-resistant outer jacket 76 helps reduce slippage of the strap 70 along the object. The slip-resistant outer jacket 76 extends at least along partially along the strap 70. The slip-resistant outer jacket 76 may be any material that increases the coefficient of friction of the strap 70 and, thus, helps reduce slippage. The slip-resistant outer jacket 76, for example, may be a fabric covering, a tape or other wrap, a molded polymer sleeve, and/or a chemical/plastic dip. FIG. 6 shows the strap 70 comprising a rubber outer jacket 78 to reduce slippage along the object.

Figure 7:
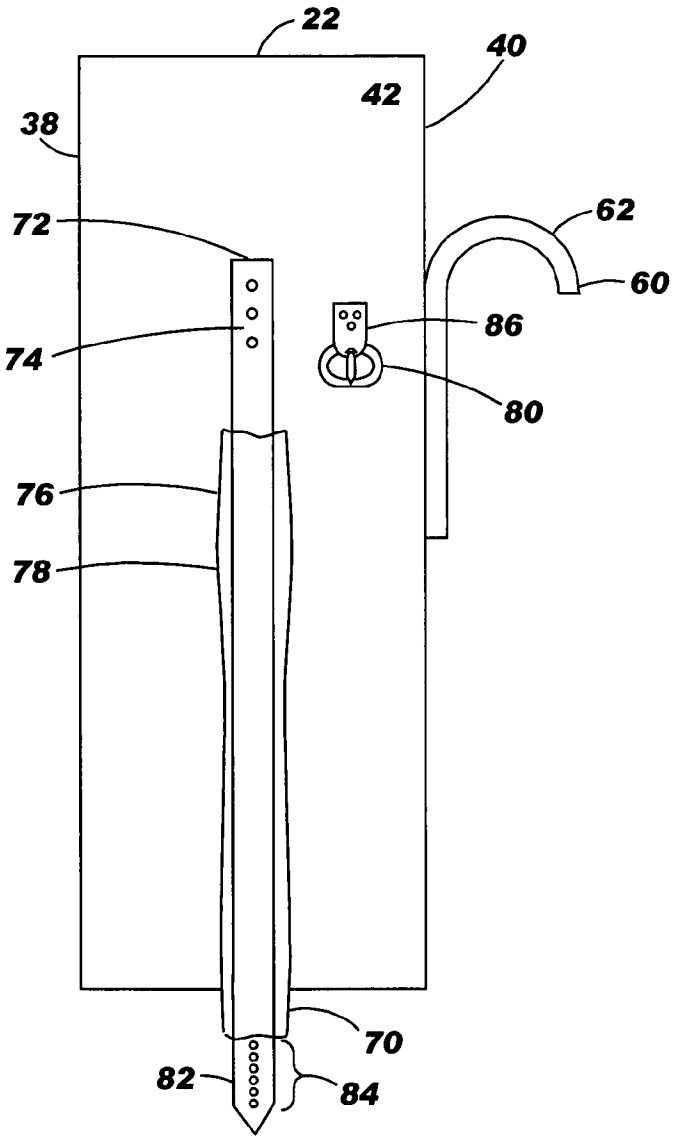
FIG. 7 is another side orthographic view illustrating more details of the sleeve according to more embodiments of this invention.

FIG. 7 is a side orthographic view illustrating more details of the sleeve 22 shown in FIGS. 1–6. Here the sleeve 22 comprises a buckle 80 for further securing the sleeve, and thus the leg of the ladder, to the object. After the ladder (shown as reference numeral 10 in FIG. 1) is propped against the object, and after the strap 70 is wrapped around the object, a second end 82 of the strap 70 is secured with the buckle 80. The second end 82 of the strap 70 includes a column of holes 84, and the second end 82 of the strap 70 inserts into and through the buckle 80. The column of holes 84 allows the second end 82 of the strap 70 to be adjusted within the buckle 80 in the conventional manner. The buckle 80 is shown attached to the side section 42, although the buckle 80 may alternatively be attached to any portion of the sleeve 22. FIG. 6 shows the buckle 80 attached to the side section 42 by one or more rivets 86. The buckle 80, however, could also be attached using bolts, screws, other threaded fasteners, adhesives, threading/stitching, buckle, snap, or knot.

Figure 8:
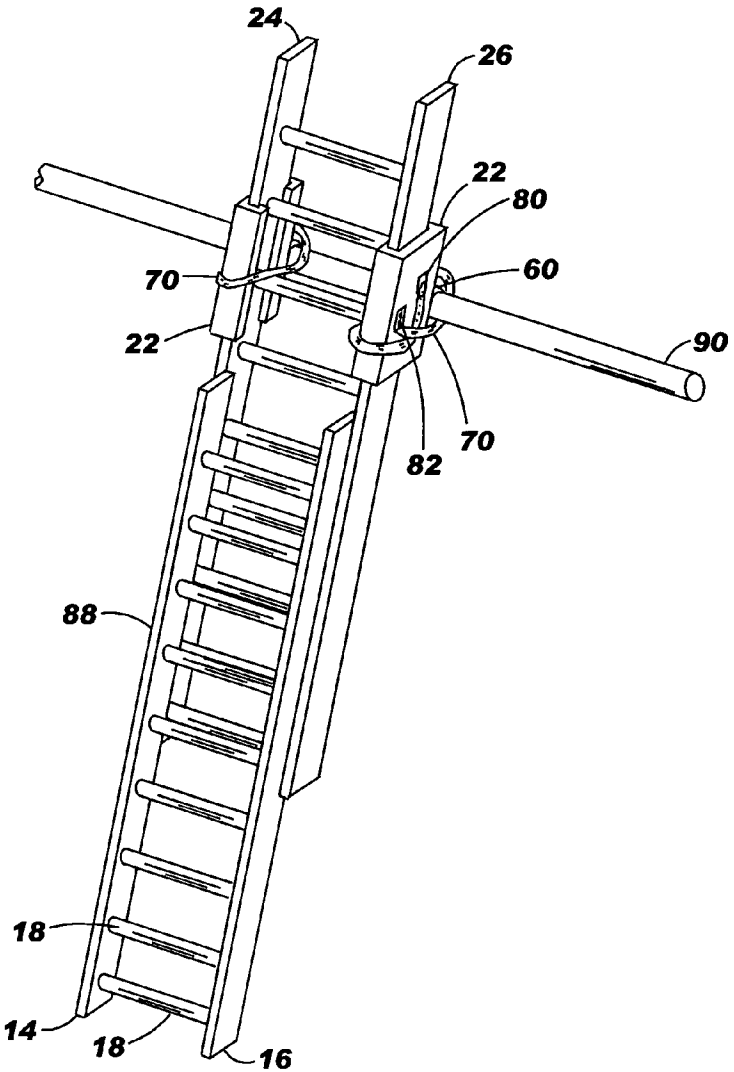
FIG. 8 is a schematic illustrating an extension ladder in an upright position and propped against a communications cable, according to even more embodiments of this invention.

FIG. 8 is a schematic illustrating another of the operating environments for this invention. FIG. 8 shows an extension ladder 88 in an upright position and propped against a communications cable 90. In the field of telecommunications, the ladder 88 must frequently be propped against the communications cable 90 to access a terminal (not shown for simplicity). The sleeve 22 of this invention allows a technician to quickly secure the ladder 88 according to required safety regulations. The technician first slides one sleeve 22 over the end 24 of the leg 14, while another sleeve 22 is slid over the end 26 of the other leg 16. The technician then longitudinally adjusts each sleeve 22 along the respective leg 14, 16 to a desired position/height. Once each sleeve 22 is positioned, the technician then extends the ladder 88 until each respective hooking member 60 grabs, or "hooks," the communications cable 90. The technician may now climb the ladder 88, wrap the strap 70 around the communications cable 90, and then secure the second end 82 of the strap 70 to the buckle 80. The hooking members 60 are thus only a temporary securement until the technician can ascend the ladder 88 and harness the sleeve 22, and thus the ladder 88, to the communications cable 90. Because each hooking member 60 preferably includes the slip-resistant material (shown as reference numeral 66 in FIG. 5), the slip-resistant hooking member helps reduce the ladder 88 from slipping along the communications cable 90. The slip-resistant outer jacket (shown as reference numeral 76 in FIG. 6) of the strap 70 also helps reduce the ladder 88 from slipping along the communications cable 90.

The sleeve 22 can be constructed of any material. Because the sleeve 22 helps reduce marring of the object, the sleeve 22 may be constructed of a polymer/plastic material. The sleeve 22, however, could also be constructed of a metal material, a glass material, a ceramic material, a fiber-reinforced material, a composite material, and/or wood products. The sleeve 22 may also include soft padding on the front section 38, the back section 40, and/or the side section 42 to further reduce marring. A fabric covering may additionally or alternatively also help reduce marring. The sleeve 22 may be advantageously constructed of an electrically insulating material and/or a lesser conducting material for electrical/communications applications and uses (such as shown in FIG. 8).

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. An apparatus, comprising:

a sleeve for a single leg of a ladder, the sleeve comprising a length of generally "U"-shaped cross-sectional material, the sleeve for sliding over an end of the leg of the ladder, each rung of the ladder sliding along an open portion of the generally "U-shaped" cross-section as the sleeve is slid over and along the leg of the ladder, the sleeve comprising a front section, a back section, and a side section, the front section extending from one end of the side section and the back section extending from an opposite end of the side section to form the generally "U"-shaped cross-section of the sleeve;

the sleeve further comprising a flange extending at least partially along an outer edge of the front section, the flange helping retain the sleeve alone the leg of the ladder, wherein when the ladder rests against an object, the sleeve can be longitudinally adjusted along the leg to reduce marring the object from contact by the leg of the ladder.

2. An apparatus according to claim 1, wherein the sleeve further comprises a flange extending at least partially along an outer edge of the back section, the flange helping retain the sleeve along the leg of the ladder.

3. An apparatus, comprising:

a sleeve for a single leg of a ladder, the sleeve comprising a length of generally "U-shaped" cross-sectional material, the sleeve for sliding over an end of the leg of the ladder, each rung of the ladder sliding along an open portion of the generally "U"-shaped cross-section as the sleeve is slid over and along the leg of the ladder, the sleeve also comprising a hooking member attached to the sleeve, the hooking member for hooking an object, and thus securing the leg of the ladder, to the object, wherein when the ladder rests against an object, the sleeve can be longitudinally adjusted along the leg to reduce marring the object from contact by the lea of the ladder.

4. An apparatus according to claim 3, wherein the hooking member comprises a slip-resistant material to reduce slippage along the object.

5. An apparatus according to claim 3, wherein the hooking member comprises a rubber sleeve to reduce slippage along the object.

6. An apparatus according to claim 3, wherein the hooking member is a "J"-shaped hook attached to the sleeve.

7. An apparatus according to claim 3, further comprising a strap having a first end attached to the sleeve, the strap for securing the sleeve, and thus the leg of the ladder, to the object.

8. An apparatus according to claim 7, wherein the strap comprises a slip-resistant outer jacket to reduce slippage along the object.

9. An apparatus according to claim 7, wherein the strap comprises a rubber outer jacket to reduce slippage along the object.

10. An apparatus according to claim 7, further comprising a buckle attached to the sleeve, the buckle for accepting an opposite, second end of the strap, wherein after the strap is wrapped around the object, the second end of the strap is inserted through the buckle to secure the sleeve, and thus the leg of the ladder, to the object.

11. An apparatus according to claim 3, further comprising a buckle attached to the sleeve, the buckle for accepting a strap wrapped around the object, the strap inserting through the buckle to secure the sleeve, and thus the leg of the ladder, to the object.

12. An apparatus according to claim 1, further comprising a strap having a first end attached to the sleeve, the strap for securing the sleeve, and thus the leg of the ladder, to the object.

13. An apparatus according to claim 12, wherein the strap comprises a slip-resistant outer jacket to reduce slippage along the object.

14. An apparatus according to claim 12, wherein the strap comprises a rubber outer jacket to reduce slippage along the object.

15. An apparatus according to claim 12, further comprising a buckle attached to the sleeve, the buckle for accepting an opposite, second end of the strap, wherein after the strap is wrapped around the object, the second end of the strap is inserted through the buckle to secure the sleeve, and thus the leg of the ladder, to the object.

* * * * *